US006128796A

United States Patent [19]

McCormick et al.

[11] Patent Number: 6,128,796

[45] Date of Patent: Oct. 10, 2000

[54] DEVICE FOR PATIENT TRANSPORT

[75] Inventors: David A. McCormick, Gold Canyon; Rickey L. Salyers, Waddell; Martha S. McCormick, Gold Canyon, all of Ariz.

[73] Assignee: 2Protectu, Inc., Gold Canyon, Ariz.

[21] Appl. No.: 09/425,513

[22] Filed: Oct. 22, 1999

[51] Int. Cl.[7] ..... A61G 1/01; A47G 9/02

[52] U.S. Cl. ..... 5/626; 5/627; 5/497; 5/663

[58] Field of Search ..... 5/626, 625, 627, 5/663, 81.1 T, 482, 485, 495, 497

[56] References Cited

U.S. PATENT DOCUMENTS

| | | | |
|---|---|---|---|
| 5,575,025 | 11/1996 | Peters | 5/600 |
| 5,579,547 | 12/1996 | Hunt | 5/86.1 |
| 5,615,425 | 4/1997 | Corente | 5/625 |
| 5,784,730 | 7/1998 | Hunt | 5/86.1 |
| 5,819,339 | 10/1998 | Hodgetts | 5/88.1 |
| 5,978,989 | 4/1999 | Chavez | 5/627 |

FOREIGN PATENT DOCUMENTS

| | | | |
|---|---|---|---|
| 2672 | 11/1918 | Netherlands | 5/627 |
| 468336 | 7/1937 | United Kingdom | 5/625 |

*Primary Examiner*—Alexander Grosz
*Attorney, Agent, or Firm*—Gray Cary Ware & Freidenrich LLP; June M. Learn

[57] ABSTRACT

A lightweight device for transporting a patient under emergency conditions is provided. The invention patient transport device comprises a substantially rectangular sheet with at least two spaced apart lengthwise reinforcing members attached along at least the mid- portion of the length of the sheet, at least two spaced apart crosswise reinforcing members attached to the sheet and to the lengthwise reinforcing members, and weight-bearing handles attached to the crosswise reinforcing members. The invention device, which is optionally disposable, is adapted to bear the full weight of a patient lying on the sheet when the sheet is lifted by the handles and is particularly well suited to removing injured individuals or animals from an accident site and for placement onto a gurney or other means of patient transport. In various embodiments, the invention patient transport device further is adapted to serve as a fluid-resistant fitted sheet for a mattress pad such as is typically found on a gurney and has side pockets that slip over the side railings of a gurney to protect the gurney and mattress pad from contamination by bodily fluids. The device can be folded for carrying in a backpack, but is strong enough to carry an individual weighting up to about 300 pounds.

25 Claims, 3 Drawing Sheets

DEVICE FOR PATIENT TRANSPORT

FIELD OF THE INVENTION

The present invention relates generally to medical equipment, and more particularly to a protective covering that prevents the spread of infection by gurneys and other nonsterile patient bearing structures.

BACKGROUND OF THE INVENTION

In time of war or during emergency operations occasioned by fire, earthquake, flood and other natural disasters, the injured or dead need to be moved from sites to which gurneys typically cannot gain access. Ambulances and paramedic units frequently need to transport patients from accident sites to gurneys for further transfer to a hospital or clinic. At the hospital or clinic, the patient must further be transported from the ambulance gurney to a gurney or temporary bed at the emergency room. Various types of medical facilities utilize gurneys and other various stationary and mobile patient bearing structures, such as carts, beds, and tables, to examine and/or transport patients within the facility.

During such patient transfers, potentially infectious biological fluids, such as blood and mucus, may contaminate the surfaces or soak into mattresses, and the like, on such patient bearing structures, thereby increasing susceptibility to infection for occupants, as well as for medical practitioners and facility personnel.

Fresh linen is typically placed onto mattresses of patient bearing structures prior to each new patient's occupancy, but washing or cleaning of patient bearing structures is considerably less frequent. Manual cleaning often consumes valuable nursing time and also removes the patient bearing structure from service for an extended period of time. Further, manual cleaning is not sufficiently reliable because contaminated stains are seldom completely eliminated, and thus the risk of transferring pathogens still exists.

To overcome the problem of contamination of gurneys and/or gurney mattresses, U.S. Pat. No. 5,575,025 discloses a gurney with a protective covering having side pieces that fit over the railings of a gurney. The gurney side railings can be raised or lowered while the protective covering is in place. However, the gurney covering does not led itself to transport of a patient either to the gurney or from the gurney to another patient bearing structure.

Many of the devices in use for patient transfer are mechanically complicated or require undue manipulation of the patient. For example, a survey of existing practices and techniques suggests that there are a number of devices and methods for transferring patients that utilize a hoist type lift where the patient is suspended in a sling. The sling must first be manipulated under the patient and then the patient must be physically lifted. There are also roller boards which are inserted partially under the patient and then the patient is pulled onto the roller board. Again, the patient must be manipulated to allow the board to be inserted and then the body is pulled onto the board. In the end, the patient ends up on the board, not on the gurney or bed. An additional disadvantage of the roller board is that either the patient must cooperate with the individual making the transfer, or more than one person is required to effect the transfer.

For example, U.S. Pat. No. 5,579,547 covers a lift/transfer mechanism mounted on an otherwise generally conventional patient gurney, suited for lifting and transferring a patient between the gurney and an adjacent bed or operating table.

The mechanism is designed to allow a single orderly to roll the patient onto or off of the transfer mechanism, thereby allowing most transfers to be completed by only one orderly. A patient board is part of the lift/transfer mechanism and provides the platform upon which the patient would lie while being moved to or from the gurney. However, an elaborate mechanical apparatus is needed to operate the lift mechanism, including boom arms respectively mounted at two adjacent corners of the gurney, lift straps connected between the boom arms and the patient board, and an electrical winch to lift and lower the patient board vertically as needed. Further examples of such patient transport systems are provided in U.S. Pat. Nos. 5,819,339 and 5,784,730.

Accordingly, there is still a need in the art for an inexpensive, preferably fluid resistant and/or disposable, patient transport device designed to carry a patient from a site of injury and/or to place the patient upon a gurney or other patient transport device.

BRIEF DESCRIPTION OF THE INVENTION

The present invention overcomes many of the problems in the art by providing devices for patient transport. The invention patient transport device comprises a substantially rectangular sheet having spaced apart head and foot edges, and laterally spaced apart side edges, at least two spaced apart lengthwise reinforcing members attached along at least the mid- portion of the length of the sheet, at least two spaced apart crosswise reinforcing members attached to the sheet, wherein the crosswise reinforcing members are attached to the lengthwise reinforcing members, and weight bearing handles attached to the crosswise reinforcing members. The invention device is adapted to bear the full weight of an adult patient lying on the sheet when the sheet is lifted by the handles.

The sheet in the invention device is preferably made of a strong, but light weight fabric, so the weight of a patient lying on the substantially rectangular sheet is largely supported by the two sets of reinforcing members. It is preferred that one of the crosswise reinforcing members is located to support the shoulders of an adult lying upon the sheet, for example, the member is located to run under the patient within about 6 inches of the shoulder region, while the other crosswise reinforcing member is located to support the knees of an adult lying upon the sheet, for example by running under the patient within about 6 inches of the knee region. The at least two lengthwise reinforcing members cross and are attached to the crosswise members and therefore, extend at least between the two crosswise members.

In one embodiment according to the present invention, the device further comprises a lengthwise pocket running along a middle portion of the underside of each side edge of the sheet. These pockets are preferably sized to fit over the side railings of a gurney or hospital bed.

Preferably, the sheet is fabricated of a fluid resistant material, and may have an absorbent top layer or coating to absorb bodily liquids. The complete device is designed to be readily foldable and disposable, and hence can serve as a disposable "stretcher" for moving injured patients with minimal risk of contamination to the individuals that move the patient.

Accordingly, it is an object of the present invention to provide a patient transport device that is optionally disposable and impervious to bodily fluids, such as blood, for removing injured individuals or animals from an accident site and/or for placement onto a gurney or other means of patient transport.

It is another object of the present invention to provide such a devise that is adapted to serve as a fluid-resistant fitted sheet for a mattress pad such as is typically found on a gurney to protect the gurney, mattress and from contamination by bodily fluids.

It is another object of the present invention to provide such a device that can be fold ed f or carrying in a backpack, but is strong enough to carry an individual weighting up to about 300 pounds.

DETAILED DESCRIPTION OF THE INVENTION

Figure 1:
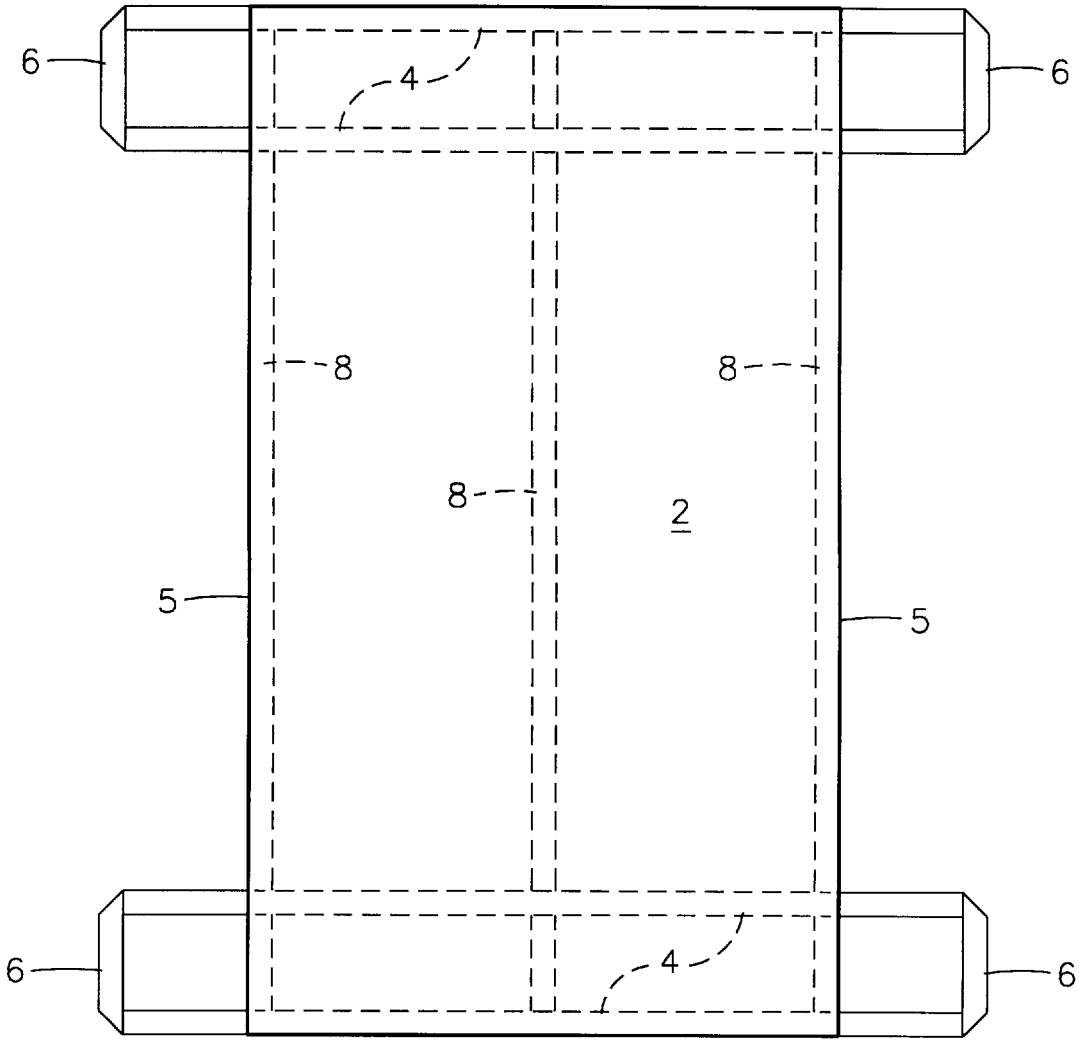
FIG. 1 is a drawing of a top view of an embodiment of the invention device. The dotted lines indicate reinforcing members attached to the underside of the device.

In accordance with the present invention, there are provided devices for patient transport. The invention patient transport device comprises a substantially rectangular sheet having spaced apart head and foot edges, and laterally spaced apart side edges, at least two spaced apart lengthwise reinforcing members attached along at least the mid- portion of the length of the sheet, at least two spaced apart crosswise reinforcing members attached to the sheet, wherein the crosswise reinforcing members are attached to the lengthwise reinforcing members, and weight bearing handles attached to the crosswise reinforcing members. The invention device is adapted to bear the full weight of an adult patient lying on the sheet when the sheet is lifted by the handles.

The sheet in the invention device is preferably made of a strong, foldable, and light weight fabric. Preferably, the sheet is fabricated of a fluid resistant material (e.g., waterproof) and may have an absorbent layer or coating on the top surface to absorb bodily liquids. For example, the sheet can be fabricated of such materials as canvas, nylon, or polypropylene fabric, and the like. The material presently preferred for fabrication of the sheet in a fluid-resistant version of the invention device is a polypropylene fabric, optionally with a polyethylene absorbent coating at least on the top side of the sheet. To provide sufficient strength, a material having weight bearing capacity equivalent to a 4 ounce polypropylene fabric should be used. For example or two layers of 2 ounce polypropylene fabric can be advantageously employed. When two or more thicknesses of fabric are employed, it is generally convenient to attached the thicknesses of material together at least along the periphery of the sheet.

During use, the weight of a patient lying on the substantially rectangular sheet is largely supported by the two sets of reinforcing members. It has been determined that the spacing between the crosswise reinforcing members is important in balancing the weight of a patient. For example, if the crosswise members are placed at the head and foot edges of the sheet, the patient tends to fold at the mid-section when the handles of the device are grasped to lift the patient for transport. Conversely, if the crosswise members are located too close to the mid length of the substantially rectangular sheet, the patient's head and arms may tend to flop without adequate support when the handles of the device are grasped to lift the patient for transport.

Therefore, it is preferred that one of the crosswise reinforcing members is located to support the shoulders of an adult lying upon the sheet, for example, one crosswise reinforcing member can be located to run under the patient within about 6 inches of the shoulder region, while the other crosswise reinforcing member is located to support the knees of an adult lying upon the sheet, for example by running under the patient within about 6 inches of the knee region.

Generally, the handles are attached to the at least two crosswise reinforcing members at or near each side edge of the sheet, making a total of four handles. In this embodiment, it is convenient for two carriers to man the device. If one carrier is to stand at each side edge of the sheet, the spacing between the at least two crosswise reinforcing members is preferably adjusted to accommodate the average reach of an adult carrier with both arms outstretched in a weight-carrying posture.

The at least two lengthwise reinforcing members cross and are attached to the crosswise reinforcing members and, therefore, extend at least between the two crosswise members. The lengthwise reinforcing members may additionally crisscross the length of the substantially rectangular sheet. Additional lengthwise reinforcing members may be added, as desired. For example, a third spaced apart lengthwise reinforcing member may be positioned at the mid-width of the sheet to provided added weight-bearing support for the device.

The reinforcing members in the invention device can be fabricated of any pliable, strong material, such as leather or vinyl straps, nylon, polyester, or cotton webbing, and the like. The reinforcing members are preferably attached along the underside of the sheet to enhance the weight-bearing properties of the invention device and can be attached to the sheet by any convenient means, such as by sewing, gluing, heat fusion, and the like. However, a limited amount of fluids can seep through the holes made by stitching the reinforcing members to the sheet. Therefore, if the device is intended to be impervious to fluids, stitching of the reinforcing members to the sheet should be minimized or avoided.

In the embodiment of the invention device shown in FIG. 1, sheet 2 has two pairs of spaced apart crosswise reinforcing members 4. In this embodiment, the crosswise reinforcing members are located near the head and foot edges of the device, and preferably the sheet is dimensioned so that one pair of the crosswise reinforcing members would support the shoulder area of a patient while the other pair would support the back of the knees of the patient. Handles 6 for the device are formed by each pair of crosswise reinforcing members extending to form a loop on either side edge 5 of the sheet, with each loop serving as one of the handles 6 to be used for lifting the device. Three equally spaced apart lengthwise reinforcing members 8 attach to all of the crosswise reinforcing members 4 for support. In this embodiment, the invention device is particularly well suited for emergency use or use by military personnel, for example to carry wounded soldiers from the battlefield. Due to the simplicity of design, the device is readily foldable and disposable and hence can serve as a disposable "stretcher" for moving injured patients. The device is preferably sufficiently light weight and pliable to fold for carrying in a backpack, for example, by military personnel. If the device is fabricated of a fluid-resistant material, the device can be utilized with minimal risk of contamination to the individuals that move the patient.

The dimensions of the sheet and placement of the reinforcing members can be varied, depending upon the size of the patient to be transported using the invention device and the use for which the invention transport device is contemplated. Although the term "patient" as used herein generally means a human adult, it is contemplated within the scope of the invention that the device can be appropriately sized for carrying a child or small animal, such as a dog, as the patient. Adult humans weighting up to 300 pounds have been successfully transported using an example of the invention device.

Figure 2:
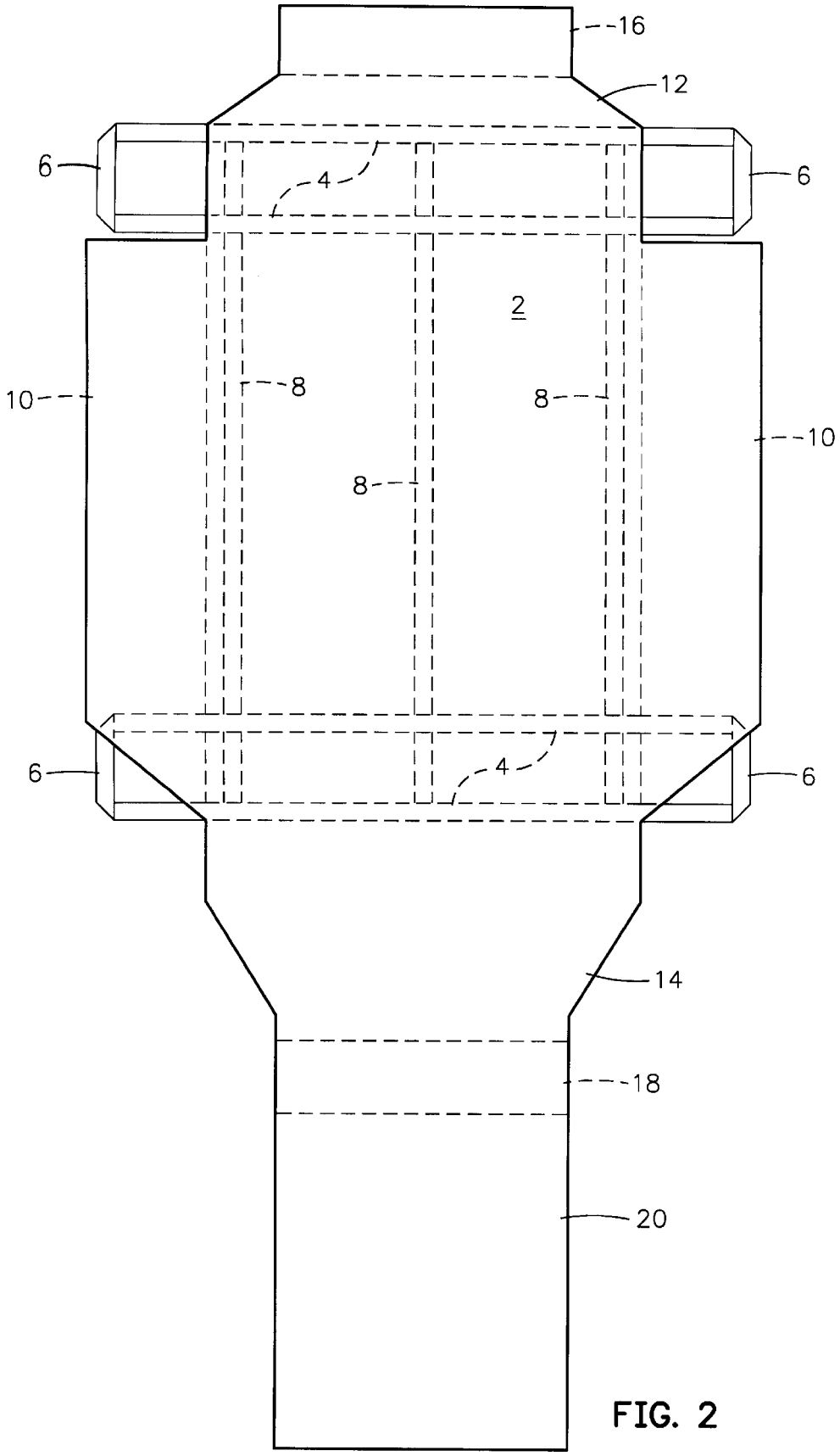
FIG. 2 is a drawing of a top view of another embodiment of the invention device. The, dotted lines indicate reinforcing members attached to the underside of the device and the locations of pockets attached to the underside of the device.

In the embodiment of the invention device shown in FIG. 2, the device is adapted for placement upon a gurney or hospital bed with side railings and with a mattress pad upon which the device can be placed in the manner of a fitted sheet. In this embodiment, the device further comprises a lengthwise pocket (shown in shadow) running along a middle portion of the underside of each side edge of the sheet. These pockets are preferably sized to fit over the side railings of a gurney or hospital bed. For example, a presently preferred depth for the lengthwise pockets is from about 6 to about 10 inches. As shown in FIG. 2, the lengthwise pocket is formed by a continuous sidewise extension of sheet 2 along each side edge, which extension is folded back upon itself and secured along the edges of the extension to form the lengthwise pockets 10. Alternatively, the lengthwise pockets 10 can be formed from a separate extension piece of material that is attached (e.g., by sewing, gluing, heat sealing, and the like) along the side edge of sheet 2. Generally it is convenient to form the side extension from the same type of material used to fabricate sheet 2.

The embodiment of the invention device shown in FIG. 2 further comprises a head portion 12 including an underside sidewise pocket 16 and a foot portion 14 including a sidewise pocket 18. The sheet is dimensioned to cover and protect a mattress or pad such as is typically found on a gurney with the two underneath sidewise pockets 16 and 18 being dimensioned to receive the ends of such a mattress while the sheet underside lies along the surface of the mattress. Thus, the device functions as a fitted sheet for the gurney mattress or pad in the manner of a fitted sheet. In addition, the foot portion in this embodiment of the invention device optionally further includes a foot extension 20 that can be folded back over at least the feet of a patient lying on the sheet.

Figure 3:
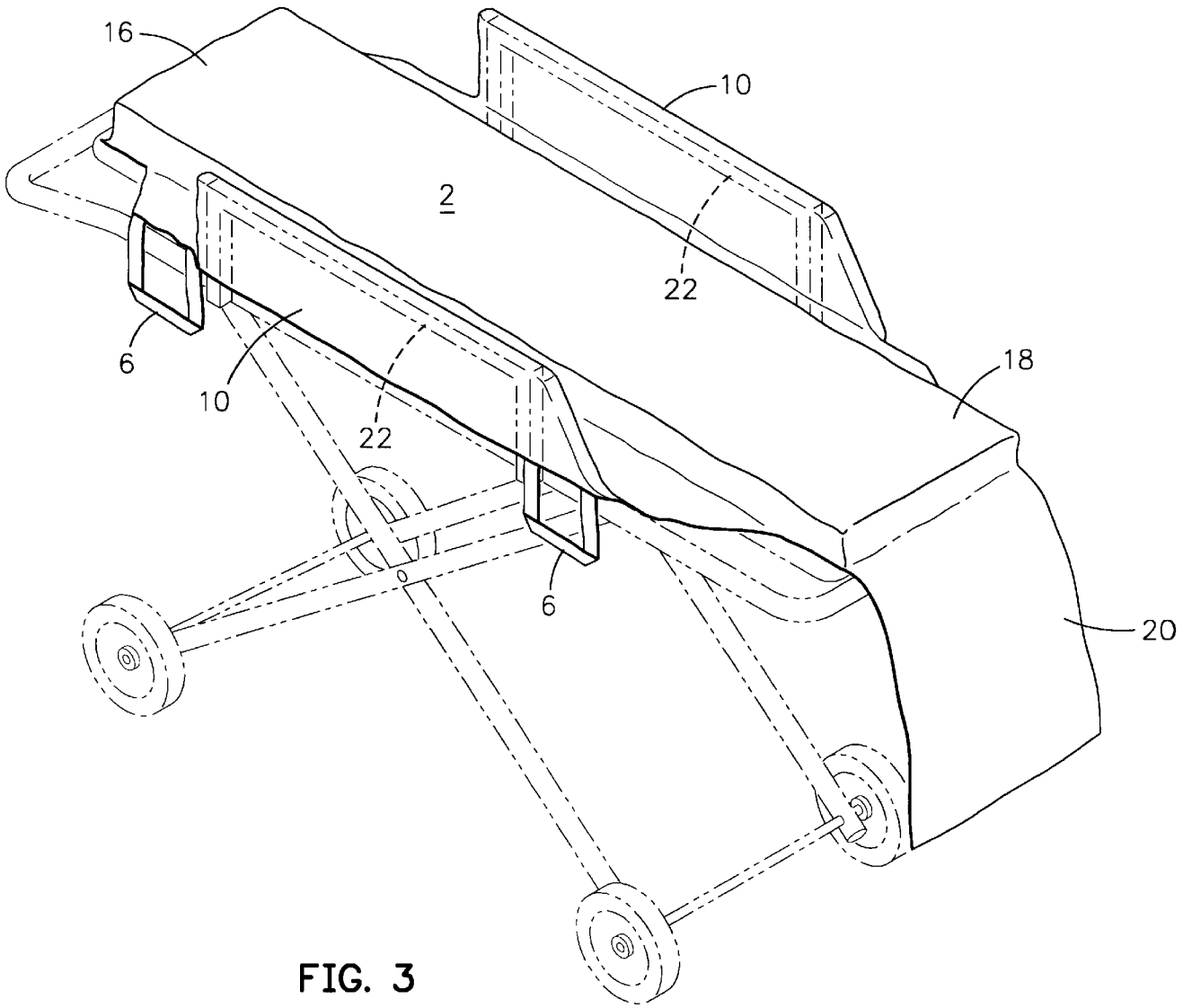
FIG. 3 is a drawing showing the invention device used as a cover for a gurney pad.

FIG. 3 shows invention the device illustrated in FIG. 2 in use on a gurney 23 with side railings 22; wherein the lengthwise pockets 10 fold upwards at an angle from sheet 2 and are positioned to slip down over the vertical side railings 22 of the gurney 23. The sidewise head pocket 16 and sidewise foot pocket 18 of the device (not visible in this Figure) are slipped over the ends of the gurney pad in the manner of a fitted sheet to secure the invention device to the gurney.

The invention device can be in any convenient color. Suitable colors include, but are not limited to, white, dark blue, black, khaki, military camouflage, and the like, or a combination thereof.

While the invention has been described in detail with reference to certain preferred embodiments thereof, it will be understood that modifications and variations are within the spirit and scope of that which is described and claimed.

What is claimed is:

1. A device for patient transport comprising:

a substantially rectangular sheet having spaced apart head and foot edges, and laterally spaced apart side edges, at least two spaced apart lengthwise reinforcing members attached along at least the mid-portion of the length of the sheet, at least two spaced apart crosswise reinforcing members attached to the sheet wherein the crosswise reinforcing members are attached to the lengthwise reinforcing members, a lengthwise pocket running along a middle portion of the underside of each side edge of the sheet, and weight bearing handles attached to the crosswise reinforcing members, wherein the device is adapted to bear the full weight of a patient lying on the sheet when the sheet is lifted by the handles and is dimensioned to allow the lengthwise pockets to fit over side railings attached to a gurney while the sheet underside lies along the surface of the gurney.

2. The device according to claim 1 wherein one of the crosswise reinforcing members is located at or near the head edge of the sheet and one is located at or near the foot edge of the sheet.

3. The device according to claim 1 wherein one of the crosswise reinforcing members is located at or near each end of the lengthwise pockets.

4. The device according to claim 1 wherein at least the top side of the sheet is absorbent.

5. The device according to claim 1 wherein the lengthwise reinforcing members and the crosswise reinforcing members cross each other and are attached together at the crossings.

6. The device according to claim 5 wherein two of the lengthwise reinforcing members crisscross.

7. The device according to claim 1 wherein there are three spaced apart lengthwise reinforcing members with one of the members attached along the midline of the width of the sheet.

8. The device according to claim 1 wherein there are two pairs of spaced apart crosswise reinforcing members, wherein one pair of the crosswise reinforcing members is located at or near the head edge of the sheet and one pair is located at or near the foot edge of the sheet.

9. The device according to claim 8 wherein each pair of crosswise reinforcing members extends to form a loop on either side of the sheet and wherein each loop serves as a handle for lifting the sheet.

10. The device according to claim 1 wherein the reinforcing members are straps.

11. The device according to claim 10 wherein the straps are of heavy duty polypropylene, nylon, canvas, cotton, or nylon webbing.

12. The device according to claim 1 wherein the sheet is made of a fluid-resistant material.

13. The device according to claim 12 wherein the fluid-resistant material is polypropylene with a polyethylene coating.

14. The device according to claim 1 wherein the reinforcing members are attached along the underside of the sheet.

15. The device according to claim 14 wherein the reinforcing members are attached in a fluid-tight manner to the sheet.

16. The device according to claim 1 wherein there are three lengthwise reinforcing members.

17. The device according to claim 1 wherein the sheet comprises two or more thicknesses of material attached together at least along the periphery of the sheet.

18. The device according to claim 1 wherein the sheet is disposable.

19. The device according to claim 1 wherein the sheet further comprises side extensions and the sheet and side extensions are formed from a continuous piece of material.

20. The device according to claim 19 wherein the sheet and the side extension are formed from separate pieces of material.

21. The device according to claim 19 wherein the foot further includes a foot extension that can be folded back over at least the feet of a patient lying on the sheet.

22. The device according to claim 1 further comprising a head portion including an underside sidewise pocket and a foot portion including a sidewise pocket.

23. The device according to claim 22 wherein the device is dimensioned to function as a fitted sheet with each sidewise pocket being dimensioned to receive the end of a mattress or pad.

24. The device according to claim 1 wherein the device is white, dark blue, black, khaki, or military camouflage in color, or a combination thereof.

25. The device according to claim 1 wherein the device is sufficiently light weight and pliable to fold for carrying in a backpack.

* * * * *